US011777256B2

(12) United States Patent
Fan et al.

(10) Patent No.: US 11,777,256 B2
(45) Date of Patent: Oct. 3, 2023

(54) ELECTRICAL CONNECTOR AND METHOD FOR MATING AND UNMATING THE SAME

(71) Applicant: Amphenol Commercial Products (Chengdu) Co., Ltd., Chengdu (CN)

(72) Inventors: Jun Fan, Chengdu (CN); Tao Zeng, Chengdu (CN)

(73) Assignee: Amphenol Commercial Products (Chengdu) Co., Ltd., Chengdu (CN)

( * ) Notice: Subject to any disclaimer, the term of this patent is extended or adjusted under 35 U.S.C. 154(b) by 100 days.

(21) Appl. No.: 17/357,547

(22) Filed: Jun. 24, 2021

(65) Prior Publication Data

US 2021/0408727 A1 Dec. 30, 2021

(30) Foreign Application Priority Data

Jun. 28, 2020 (CN) ..... 202010599155.7
Jun. 28, 2020 (CN) ..... 202021217906.6

(51) Int. Cl.
*H01R 13/627* (2006.01)
*H01R 13/641* (2006.01)
*H01R 12/70* (2011.01)
*H01R 13/639* (2006.01)

(52) U.S. Cl.
CPC ..... *H01R 13/641* (2013.01); *H01R 12/7005* (2013.01); *H01R 13/639* (2013.01)

(58) Field of Classification Search
CPC ..... H01R 13/6275; H01R 13/641
See application file for complete search history.

(56) References Cited

U.S. PATENT DOCUMENTS 4,886,462 A * 12/1989 Fierro ..... H01H 1/5805 439/620.08
5,330,366 A * 7/1994 Tsuji ..... H01R 13/6271 439/352
5,538,437 A * 7/1996 Bates, III ..... H01R 13/6275 439/352
5,554,045 A * 9/1996 Bethurum ..... H01R 12/7005 439/372
5,641,299 A * 6/1997 Meguro ..... H01R 13/639 439/489
5,683,264 A * 11/1997 Hobgood ..... H01R 13/641 439/352
5,825,627 A * 10/1998 Tamura ..... H05K 5/0021
(Continued)

*Primary Examiner* — Neil Abrams
(74) *Attorney, Agent, or Firm* — Wolf, Greenfield & Sacks, P.C.

(57) ABSTRACT

An electrical connector and a method for mating and unmating the same. The electrical connector comprises a housing, a locking arm, a biasing member, and a sliding member. The locking arm comprises a first end, a second end, and an intermediate portion between the first end and the second end. The first end comprises a locking portion. The intermediate portion is pivotably mounted to the housing about a pivot. The biasing member is engaged with the locking arm to drive the first end in a first direction. The sliding member is slidably connected to the housing and configured to slide in a second direction perpendicular to the first direction. The electrical connector may be securely locked to a mating electrical connector and has a compact structure, allowing the mating electrical connector to be mounted on a circuit board that has a compact structure.

20 Claims, 11 Drawing Sheets

(56) References Cited

U.S. PATENT DOCUMENTS

| | | | | | |
|---|---|---|---|---|---|
| 6,050,658 | A * | 4/2000 | O'Sullivan | G11B 33/126 | |
| 6,146,180 | A * | 11/2000 | Betker | H01R 13/6273 | 439/352 |
| 6,149,450 | A * | 11/2000 | Gastineau | G06K 19/07741 | 439/352 |
| 6,379,173 | B1 * | 4/2002 | Fonteneau | H01R 13/6273 | 439/352 |
| 6,699,059 | B2 * | 3/2004 | Nagamine | H01R 13/6273 | 439/352 |
| 6,799,986 | B2 * | 10/2004 | Igarashi | H01R 13/6275 | 439/358 |
| 7,040,911 | B1 * | 5/2006 | Ho | G02B 6/4292 | 439/352 |
| 7,594,827 | B2 * | 9/2009 | Takamoto | H01R 13/6397 | 439/353 |
| 8,192,221 | B2 * | 6/2012 | Schmettkamp | H01R 13/62 | 439/345 |
| 9,219,333 | B2 * | 12/2015 | Wang | H01R 13/6275 | |
| 10,283,908 | B1 * | 5/2019 | Simmons | H01R 13/635 | |
| 10,795,101 | B2 * | 10/2020 | Dong | G02B 6/4261 | |
| 11,276,958 | B2 * | 3/2022 | Liu | G02B 6/4261 | |

* cited by examiner

ELECTRICAL CONNECTOR AND METHOD FOR MATING AND UNMATING THE SAME

CROSS-REFERENCE TO RELATED APPLICATIONS

This application claims priority to and the benefit of Chinese Patent Application Serial No. 202021217906.6, filed on Jun. 28, 2020. This application also claims priority to and the benefit of Chinese Patent Application Serial No. 202010599155.7, filed on Jun. 28, 2020. The entire contents of these applications are incorporated herein by reference in their entirety.

FIELD

The present disclosure relates to a first electrical connector, a second electrical connector, and a method for mating and unmating the two.

BACKGROUND

As transmission mediums, electrical connectors have been widely used in electronic products; they may be used to establish communication or fast power connections between systems and devices. With the dawn of the information age, people have increasingly stricter requirements on the frequency of use of and functions of electronic products, and electronic products have become more and more compact. As a result, more requirements have been imposed on electrical connectors.

Because conventional electrical connectors have large and complicated locking mechanism. If another element is arranged around the electrical connector, it is necessary to maintain a sufficient distance between the electrical connector and the element; consequently, its application scope is significantly limited. This goes against the trend towards increasingly miniaturized, integrated, and multi-functional electronic products.

BRIEF SUMMARY

Embodiments of electrical connectors are described.

Some embodiments relate to an electrical connector. The electrical connector may include a housing; a locking arm comprising a first end, a second end, and an intermediate portion between the first end and the second end, wherein the first end comprises a locking portion, the intermediate portion is pivotably mounted to the housing, and the second end comprises a cam surface; a biasing member engaged with the locking arm to drive the first end in a first direction; and a sliding member slidably connected to the housing, wherein the sliding member is configured to slide in a second direction perpendicular to the first direction and contact the cam surface such that the second end moves in the first direction, the locking arm pivots with respect to the housing, and the first end moves in a direction opposite to the first direction.

In some embodiments, the biasing member may be engaged with a portion of the locking arm between the pivot and the first end and configured to push the portion in the first direction.

In some embodiments, the electrical connector may further comprise a pull tab coupled to the sliding member.

In some embodiments, the pull tab may be rotatably coupled to the sliding member.

In some embodiments, the pull tab may comprise a protrusion configured to engage with the sliding member and block further rotation of the pull tab when the pull tab is rotated into a predetermined angle with respect to the sliding member.

In some embodiments, the biasing member may comprise a coil spring.

In some embodiments, the locking portion may comprise a hook extending in the first direction.

In some embodiments, the electrical connector may comprise a right-angle plug electrical connector.

In some embodiments, the locking arm is a first locking arm, and the electrical connector may further comprise a second locking arm.

In some embodiments, the second locking arm may be the mirror image of the first locking arm.

In some embodiments, the sliding member may comprise a protrusion between the first locking arm and the second locking arm and configured to contact the cam surface of the first locking arm and the cam surface of the second locking arm.

In some embodiments, the housing may comprise a first chute and a second chute that are spaced apart in the second direction and extend in the second direction. The sliding member may comprise a first sliding block matching the first chute and a second sliding block matching the second chute.

Some embodiments relate to an electrical connector. The electrical connector may include a housing, the housing being provided with an elongated opening, configured to accommodate a mating portion of a mating electrical connector. The elongated opening may be surrounded by a wall of the housing. The wall may comprise a middle portion having at least one groove. The opposite sides of the at least one groove may comprise an undercut portion. The undercut portion may be configured to engage with the locking portions of the two locking arms inserted into the at least one groove when the mating electrical connector is inserted.

In some embodiments, the electrical connector may comprise a mounting surface arranged in a plane and configured to be mounted to a surface of a printed circuit board, wherein the elongated opening and the at least one groove are formed on a surface of the housing opposite to the mounting surface.

Some embodiments relate to a method for operating a first electrical connector and a second electrical connector to mate and unmate, wherein the first electrical connector comprises at least one locking arm pivotably mounted to a first housing. The method may include: mating the first electrical connector and the second electrical connector by: inserting the first electrical connector into the second electrical connector such that a first end of the locking arm contacts a member of the second electrical connector; further inserting the first electrical connector into the second electrical connector such that the first end of the locking arm pivots away from the components of the second electrical connector; further inserting the first electrical connector into the second electrical connector such that the locking portion at the first end of the locking arm clears the member of the second electrical connector and the first end of the locking arm springs back towards the member of the second electrical connector to lock the first electrical connector to the second electrical connector; unmating the first electrical connector and the second electrical connector by: sliding the sliding member of the first electrical connector relative to the first housing such that the sliding member of the first connector contacts a second end of the locking arm; further sliding the sliding member of the first electrical connector relative to the first housing such that the sliding member of the first connector pushes the second end of the locking arm toward the member of the second electrical connector and the first end of the locking arm pivots away from the member of the second electrical connector to unlock the first electrical connector from the second electrical connector; and withdrawing the first electrical connector from the second electrical connector.

In some embodiments, sliding the sliding member of the first electrical connector may comprise pulling a pull tab connected to the sliding member of the first electrical connector.

In some embodiments, the method may further comprise rotating the pull tab relative to the sliding member and pulling the pull tab in a direction in which the sliding member slides.

In some embodiments, the member of the second electrical connector may comprise an undercut portion on a side surface of at least one groove in a second housing. The locking arm may lock the first electrical connector to the second electrical connector by latching to an underside of the undercut portion.

In some embodiments, the locking arm is a first locking arm and the first electrical connector may further comprise a second locking arm. Further inserting the first electrical connector into the second electrical connector such that the first end of the locking arm pivots away from the member of the second electrical connector may comprise pivoting a first end of the first locking arm towards a first end of the second locking arm.

In some embodiments, the locking arm is a first locking arm and the first electrical connector may further comprise a second locking arm. Further sliding the sliding member of the first electrical connector relative to the housing such that the sliding member of the first connector pushes the second end of the locking arm toward the member of the second electrical connector and the first end of the locking arm pivots away from the member of the second electrical connector may comprise pushing the second end of the first locking arm and the second end of the second locking arm in opposite directions.

These techniques may be used alone or in any suitable combination. The foregoing summary is provided by way of illustration and is not intended to be limiting.

BRIEF DESCRIPTION OF DRAWINGS

The following drawings of the present disclosure are used herein as a part of the present disclosure for understanding the present disclosure. The drawings show embodiments of the present disclosure. In the drawings:

FIGS. 5D-1 and 5D-2 show schematic diagrams for two different effects in the same operation step, with the sliding member transparent in FIG. 5D-1 and solid in FIG. 5D-2, respectively; FIGS. 5E-1 and 5E-2 as well as FIGS. 5F-1 and 5F-2, in a manner similar to that adopted by FIGS. 5D-1 and 5D-2, show schematic diagrams for different effects in two other operating steps;

FIG. 8C is a partial enlarged view of FIG. 8A after the sliding member and part of the second housing are removed; FIG. 8D is a schematic diagram showing that the first electrical connector is completely disengaged from the second electrical connector.

Figure 1:
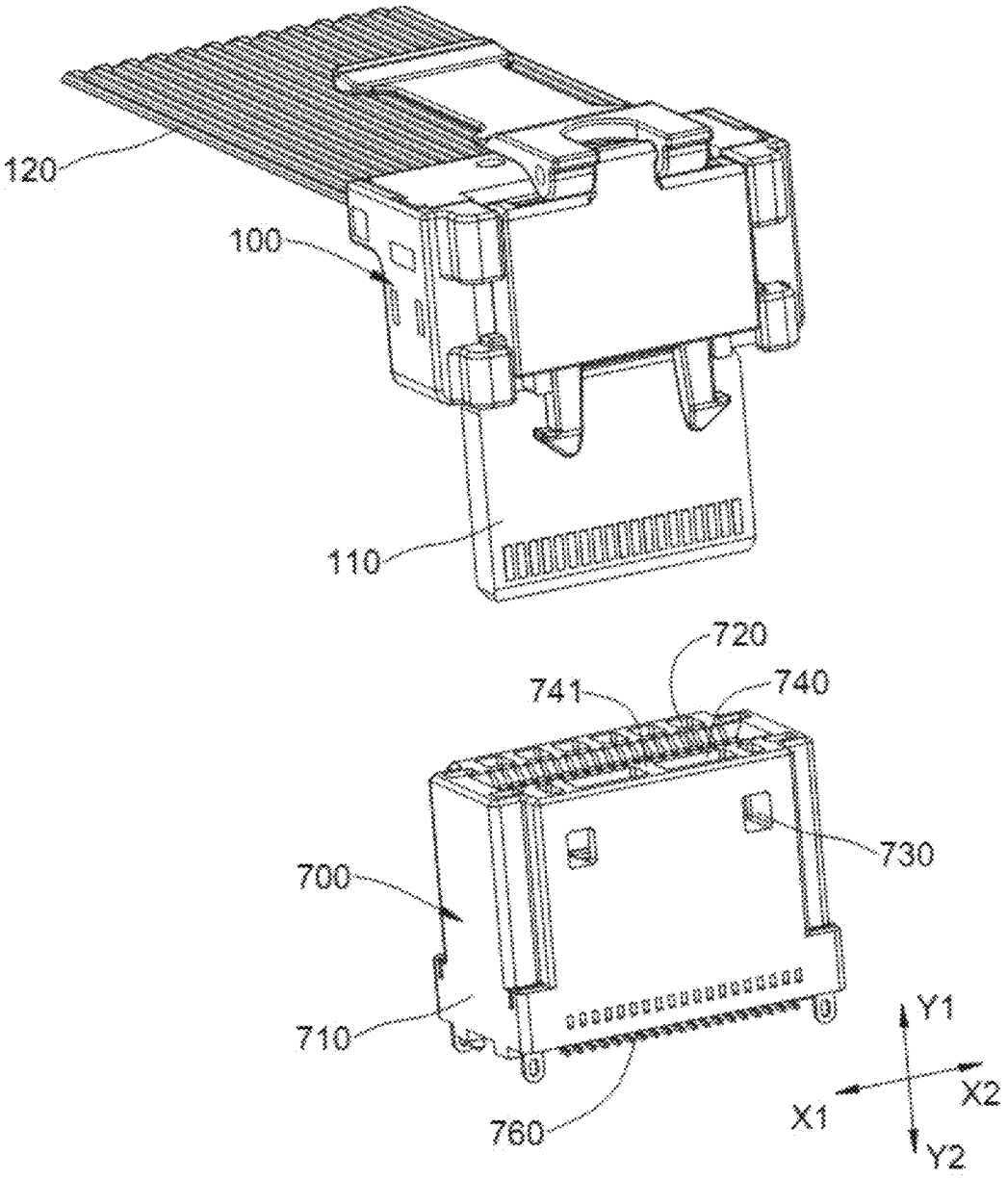
FIG. 1 is a perspective view of a first electrical connector and a second electrical connector according to an exemplary embodiment of the present disclosure, wherein the two electrical connectors are in an unmated state.

The above drawings contain the following reference numerals:

100: First electrical connector; 110: Circuit board; 120: Cable; 200: First housing; 210: Guide groove; 221: First chute; 222: Second chute; 223: Interval; 230: Stopper; 300X1: First locking arm; 300X2: Second locking arm; 310X1, 310X2: First end; 311: Locking portion; 320X1, 320X2: Second end; 321X1, 321X2: Cam surface; 330: Intermediate portion; 341, 343: Pin roll; 342: Pivot hole; 350: Positioning column; 400: Biasing member; 500: Sliding member; 521: First sliding block; 522: Second sliding block; 530: Contact protrusion; 540: Space; 600: Pull tab; 610: Operating portion; 620: Protrusion; 700: Second electrical connector; 710: Second housing; 720: Elongated opening; 730: Hole; 740: Groove; 741: Middle portion; 750: Undercut portion; 760: Mounting surface.

DETAILED DESCRIPTION

In the following description, great details are provided to provide a thorough understanding of the present disclosure. However, those of ordinary skill in the art may understand that the following description only exemplarily shows preferred embodiments of the present disclosure, and that the present disclosure may be implemented without one or more such details. In addition, in order to avoid confusion with the present disclosure, certain technical features known in the art have not been described in detail.

Figure 2:
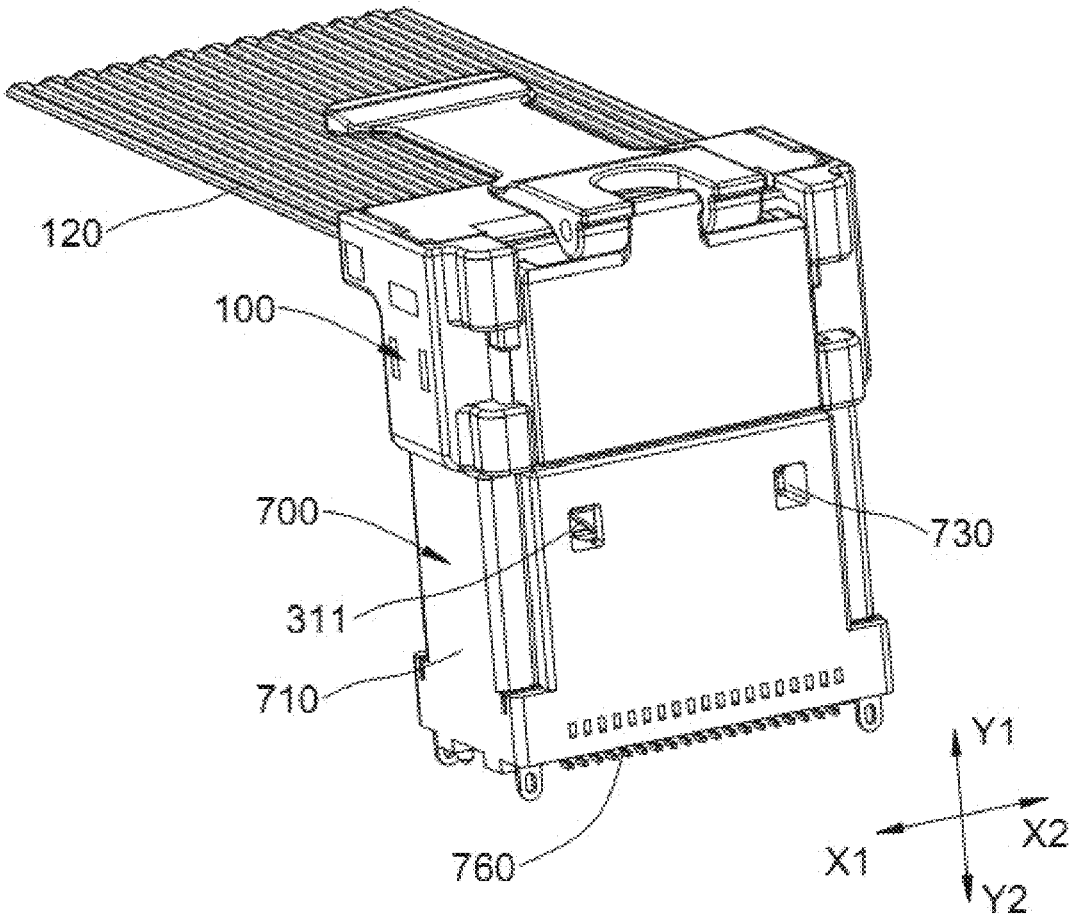
FIG. 2 is a perspective view of the first electrical connector and the second electrical connector shown in FIG. 1, wherein the two electrical connectors are in a mated state.
Figure 3:
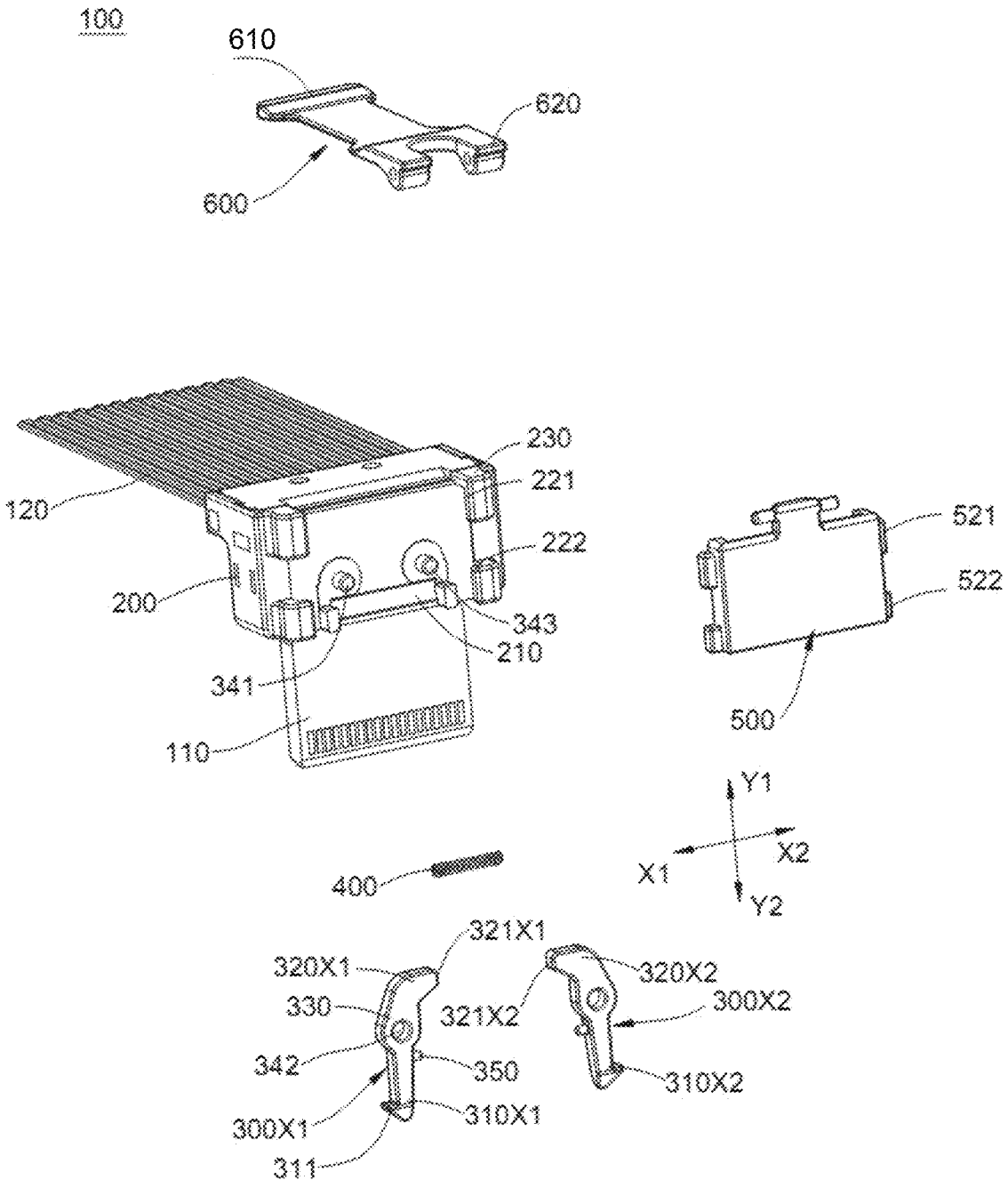
FIG. 3 is an exploded view of the first electrical connector shown in FIG. 1.

FIG. 1 and FIG. 2 are schematic diagrams for the first electrical connector 100 and the second electrical connector 700 in an unmated state and a mated state, respectively. As shown in FIGS. 1 to 3, the first electrical connector 100 may have a mating portion for connecting to an electrical connector that fits the first electrical connector 100 (for example, the second electrical connector 700 mentioned below). The mating portion may be a circuit board 110. The first electrical connector 100 may be configured such that the circuit board 110 extends from under the first electrical connector 100. A cable 120 may also be connected to the first electrical connector 100. The first electrical connector 100 may be configured such that the cable 120 extends from the back of the first electrical connector 100. The circuit board 110 and the cable 120 may be electrically connected inside the first connector 100. When viewed from the outside, the cable 120 is perpendicular to the circuit board 110, and thus the first electrical connector 100 may be called a right-angle electrical connector. The second electrical connector 700 may be electrically connected to another component, for example, a printed circuit board or a cable. When the first electrical connector 100 and the second electrical connector 700 are to mate together, the circuit board 110 may be inserted into the elongated opening 720 of the second electrical connector 700 to establish an electrical connection between the circuit board 110 and the printed circuit board that is connected to the second electrical connector 700.

The first electrical connector 100 may be provided with a locking mechanism that is configured to hold the first electrical connector 100 on the second electrical connector 700 after the first electrical connector 100 and the second electrical connector 700 are mated together, thereby establishing a reliable electrical connection between the circuit board 110 and the second electrical connector 700. The locking mechanism may enable a receptacle connector (e.g., the second electrical connector 700) to be mounted to a printed circuit board near other components that block access to the sides of the receptacle connector. The locking mechanism will be described in detail below with reference to the drawings.

As shown in FIGS. 1 to 3, the first electrical connector 100 may comprise a first housing 200, a first locking arm 300X1, a biasing member 400, and a sliding member 500.

The first locking arm 300X1 may comprise a first end 310X1, a second end 320X1, and an intermediate portion 330. The intermediate portion 330 may be located between the first end 310X1 and the second end 320X1. Optionally, the first end 310X1, the second end 320X1, and the intermediate portion 330 may be spliced together by welding, bonding, etc. Optionally, the first locking arm 300X1 may also be an integrally formed component. The intermediate portion 330 may be pivotably mounted to the first housing 200 about a pivot. In the illustrated embodiment, a pin roll 341 may be arranged on the first housing 200. A pivot hole 342 mating the pin roll 341 is arranged on the second end 320X1. The pin roll 341 is pivotable in the pivot hole 342 so that the first locking arm 300X1 is pivotably mounted to the first housing 200 with the pin roll 341 as the center. In this case, the pivot is the central axis of the pin roll 341. In another embodiment not shown, a pin roll may be arranged on the first locking arm 300X1, and a pivot hole matching the pin roll may be provided on the first housing 200. Optionally, the intermediate portion 330 may also be pivotably mounted to the first housing 200 about a pivot in any other suitable manner.

The first end 310X1 may comprise a locking portion 311. The locking portion 311 is configured to be inserted into the second electrical connector 700 when the first electrical connector 100 and the second electrical connector 700 are mated together, and to engage with a component in the second electrical connector 700, thereby locking the first electrical connector 100 and the second electrical connector 700.

As shown in FIG. 3, the locking portion 311 may comprise a hook extending in a first direction X1. Thus, the locking portion 311 has a relatively simple structure and a low manufacturing cost. Preferably, the bottom of the hook may be provided with an inclined plane. The inclined plane can perform a guiding function. When the first electrical connector 100 is inserted into the second electrical connector 700 in a direction Y2, the wall of the second electrical connector 700 can squeeze the inclined plane so that the hook is movable in a direction X2 opposite to the first direction X1, making it easier to insert the first electrical connector 100 into the second electrical connector 700.

The second end 320X1 may comprise a cam surface 321X1. The cam surface 321X1 protrudes toward the direction X2 opposite to the first direction X1. Restricted by the pivot, the cam surface 321X1 and the locking portion 311 always move in opposite directions.

The biasing member 400 may be engaged with the first locking arm 300X1. The biasing member 400 may drive the first end 310X1 in the first direction X1. The biasing member 400 may be engaged with any suitable location on the first locking arm 300X1. The biasing member 400 may be engaged with a portion of the first locking arm 300X1 located between the pin roll 341 and the first end 310X1. In this embodiment, the biasing member 400 may push the portion between the pivot and the first end 310X1 in the first direction X1. This portion corresponds to the portion between the pivot hole 342 and the first end 310X1 as shown in the figure. Thus, the space between the pivot hole 342 and the second end 320X1 remains unaffected, and this facilitates the installation of the sliding member 500, which will be described in detail below. In another embodiment not shown, the biasing member 400 may be engaged with the portion of the first locking arm 300X1 between the pivot hole 342 and the second end 320X1. In this embodiment, the biasing member 400 may pull the portion between the pivot and the first end 310X1 in the direction X2. Thus, the biasing member 400 may drive the first end 310X1 in the first direction X1.

The biasing member 400 may be engaged with the first locking arm 300X1 in any manner. In the illustrated embodiment, a positioning column 350 may be arranged on the first locking arm 300X1, and the biasing member 400 may be sleeved on the positioning column 350 to engage the biasing member 400 with the first locking arm 300X1. This makes it convenient to install and remove the biasing member 400. The biasing member 400 may comprise an elastic member, for example, a piece of rubber. Preferably, the biasing member 400 may comprise a coil spring. The coil spring has the advantages of a simple structure, reliable performance, and a low price. In this embodiment, the coil spring may be directly sleeved on the positioning column 350, making it more convenient to engage the biasing member 400 with the first locking arm 300X1. Preferably, a guide groove 210 may be provided on the first housing 200. The biasing member 400 may be accommodated in the guide groove 210. Arrangement of the guide groove 210 makes it difficult for the biasing member 400 to deviate from its operating position, thereby ensuring the stability of the operating performance of the biasing member 400.

The sliding member 500 is slidably connected to the first housing 200. The sliding member 500 may be slidably connected to the first housing 200 in any manner, for example, by a sliding block and a chute. The sliding member 500 may be configured to slide in a second direction Y1 perpendicular to the first direction X1, and contact the cam surface 321X1 at the start of sliding or during the sliding process. When the sliding member 500 continues to slide in the second direction Y1 after contacting the cam surface 321X1, the sliding member 500 pushes the cam surface 321X1 so that the second end 320X1 of the first locking arm 300X1 moves in the first direction X1, and the first locking arm 300X1 is pivotable relative to the first housing 200, thereby driving the first end 310X1 to move in a direction X2 opposite to the first direction X1. Thus, the locking portion 311 may retract from a state of being engaged with a component in the second electrical connector 700; at this time, a force may be exerted on the first electrical connector 100 in the second direction Y1 so that the first electrical connector 100 and the second electrical connector 700 are unmated.

Although the principle of the present disclosure has been explained above using a right-angle electrical connector as an example, those of ordinary skill in the art can understand that the locking mechanism described above may be used for vertical electrical connectors, coplanar electrical connectors, etc., in addition to right-angle electrical connectors.

Figure 6A:
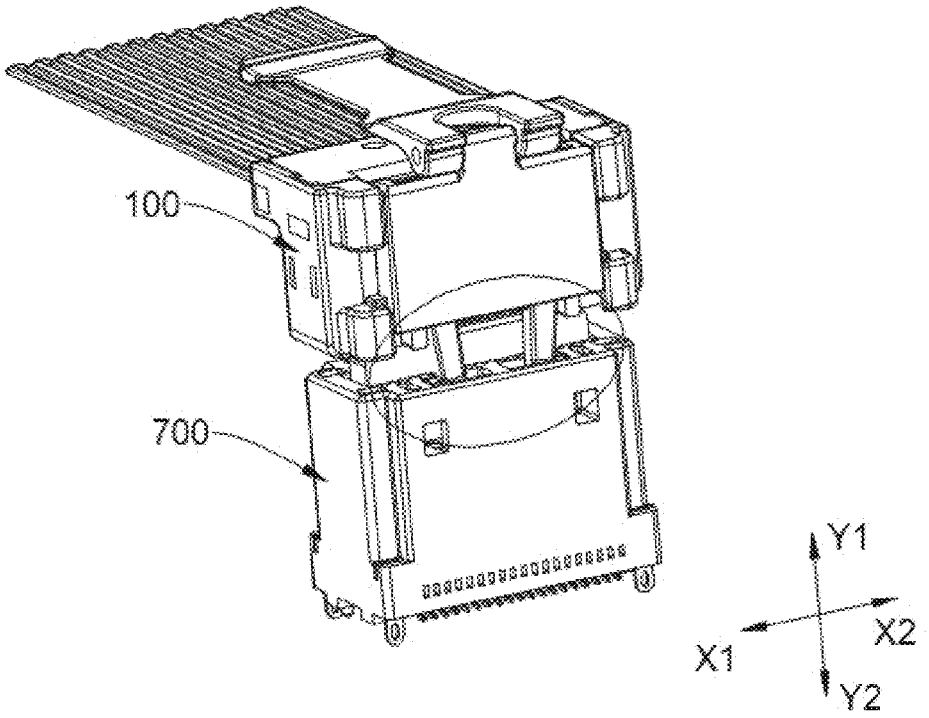
FIGS. 6A and 6B show the first electrical connector and the second electrical connector in an incompletely mated state according to an exemplary embodiment of the present disclosure, FIG. 6B being a partial enlarged view of FIG. 6A after the sliding member and part of the second housing are removed.
Figure 6B:
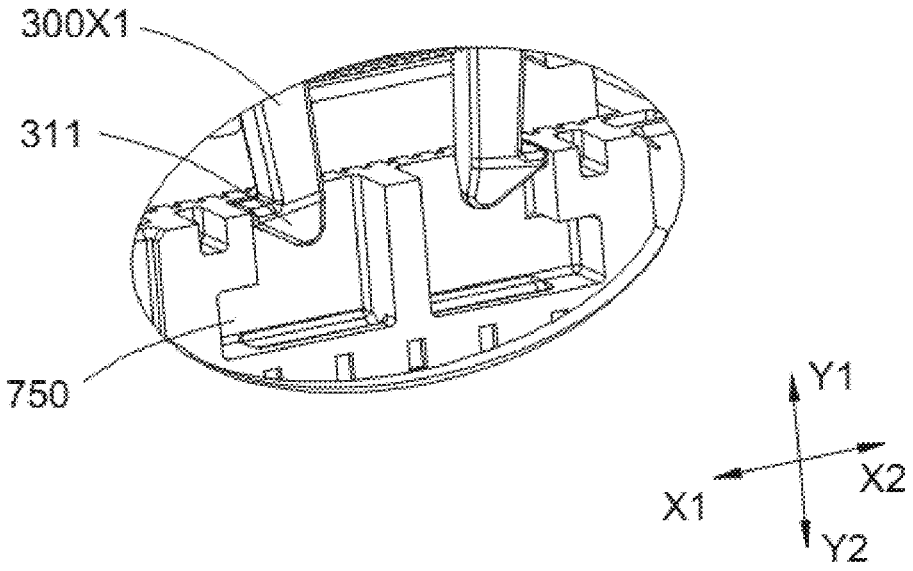

As shown in FIGS. 1 and 2, the second electrical connector 700 may comprise a second housing 710. The second housing 710 may be provided with an elongated opening 720. The elongated opening 720 may be configured to accommodate the mating portion, for example, the circuit board 110, of the first electrical connector 100. In other words, the circuit board 110 may be inserted into the elongated opening 720. The elongated opening 720 may be surrounded by a wall of the second housing 710. The second electrical connector 700 may be used for connecting to another component, for example, a printed circuit board, so that the circuit board 110 inserted into the elongated opening 720 is electrically connected to said other component. The wall may comprise a middle portion 741 having at least one groove 740. The opposite sides of the at least one groove 740 comprise an undercut portion 750, as shown in FIGS. 6A and 6B in conjunction. The undercut portion 750 may be configured to engage with the locking portions of the two locking arms inserted into the at least one groove 740 when the circuit board 110 is inserted. Preferably, the second housing 710 may be provided with a hole 730. The hole 730 may be provided on a side wall of the second housing 710, making it convenient to visually observe whether the locking portion and the undercut portion 750 are engaged in place. Preferably, the second electrical connector 700 may be a vertical connector.

Figure 7A:
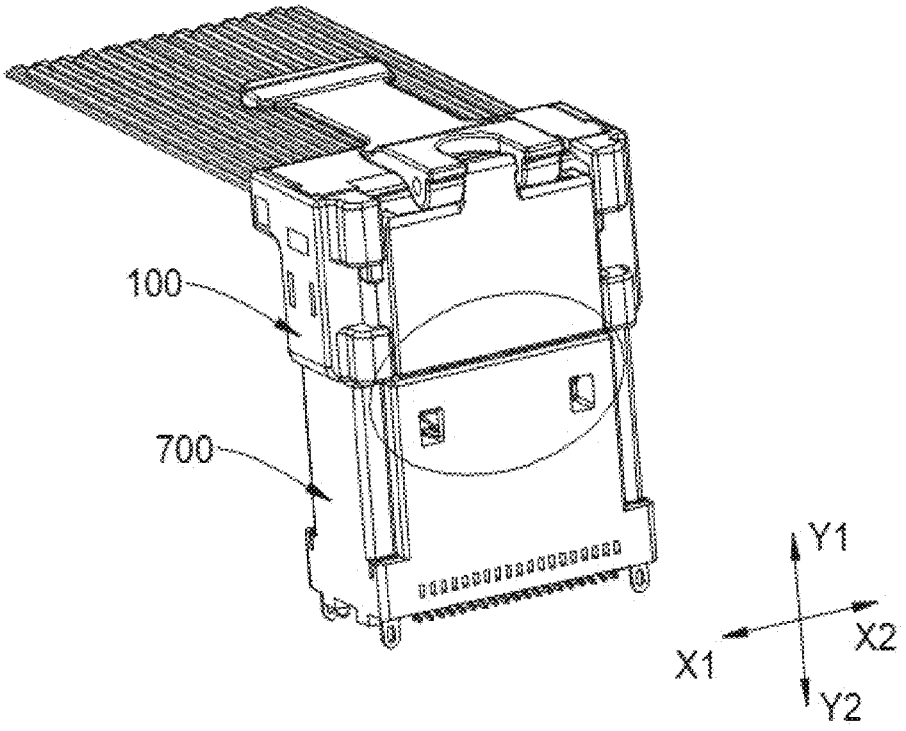
FIGS. 7A and 7B show the first electrical connector and the second electrical connector of FIGS. 6A and 6B in a completely mated state, FIG. 7B being a partial enlarged view of FIG. 7A after the sliding member and part of the second housing are removed.
Figure 7B:
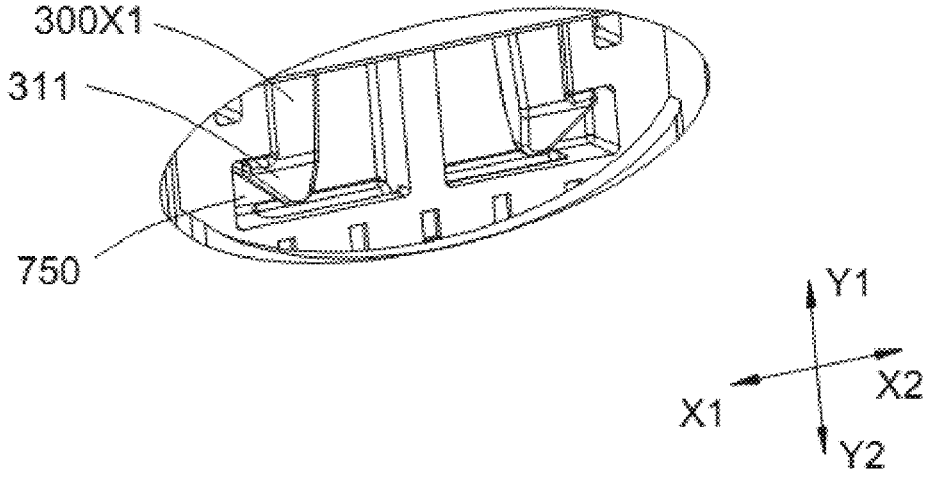

In the process of mating together the first electrical connector 100 and the second electrical connector 700, referring to FIGS. 1, 3, 6A and 6B in conjunction, first insert the first electrical connector 100 into the second electrical connector 700 so that the locking portion 311 at the first end 310X1 of the locking arm 300 can contact a member of the second electrical connector 700, for example, the undercut portion 750. Then, further insert the first electrical connector 100 into the second electrical connector 700, so that the locking portion 311 at the first end 310X1 of the locking arm 300 is pivotable in a direction away from the components of the second electrical connector 700 (that is, in the direction X2). Referring to FIGS. 7A and 7B, further insert the first electrical connector 100 into the second electrical connector 700, so that the locking portion 311 at the first end 310X1 of the locking arm 300 can cross the components of the second electrical connector 700. The first end of the locking arm 300 springs back in the opposite direction (that is, the first direction X1) opposite to the direction X2 to lock the first electrical connector 100 to the second electrical connector 700. Thus, mating of the first electrical connector 100 and the second electrical connector 700 is completed. In this case, the circuit board 110 in the first electrical connector 100 may be electrically connected to another component through the second electrical connector 700, allowing communication or other signal transmission.

With this arrangement, while it is ensured that the first electrical connector 100 and the second electrical connector 700 may be reliably mated together, the first electrical connector 100 and the second electrical connector 700 are relatively compact in structure, have regular dimensions, and are small. When the mated first electrical connector 100 and second electrical connector 700 are mounted on a printed circuit board, the second electrical connector 700 may be arranged closer to surrounding components on the printed circuit board. Therefore, under the condition that the size of the printed circuit board remains unchanged, more components may be arranged on a printed circuit board, so that an electronic product provided with the printed circuit board can achieve the purpose of being miniaturized, integrated, and multi-functional.

Preferably, as shown in FIGS. 1 to 3, the first electrical connector 100 may further comprise a pull tab 600. The pull tab 600 may be connected to the sliding member 500. The pull tab 600 may be connected to the sliding member 500 in any suitable manner, for example, by welding, bonding, etc. Pulling the pull tab 600 causes the sliding member 500 to slide in the second direction Y1. Therefore, the first electrical connector 100 provided with the pull tab 600 is comfortable to operate, allowing good man-machine interaction. Preferably, the pull tab 600 may be provided with an operating portion 610. The operating portion 610 may be provided at the tail of the pull tab 600; in other words, the head of the pull tab 600 may be connected to the sliding member 500. The operating portion 610 may comprise various structures, such as a pull ring. In the illustrated embodiment, the operating portion 610 has a larger thickness and a larger width relative to the part connected to the operating portion 610, so that a force may be exerted conveniently on the pull tab 600 to pull the pull tab 600 more comfortably.

Further, as shown in FIGS. 1 to 3, the pull tab 600 is rotatably connected to the sliding member 500. Thus, when there is no need to pull the pull tab 600, the pull tab 600 may be rotated so that the pull tab 600 gets into a buckling position, so as to prevent the first electrical connector 100 from being subject to installation restrictions in certain spaces due to the pull tab 600.

Still further, as shown in FIG. 3, the pull tab 600 may comprise a protrusion 620. The protrusion 620 may be configured to engage with the sliding member 500 and prevent the pull tab 600 from further rotating when the pull tab 600 rotates to a predetermined angle relative to the sliding member 500, as shown in FIG. 7A in conjunction. In other words, in this case, the pull tab 600 cannot further rotate in this rotation direction, and can only stop or rotate in the direction opposite to this direction. The predetermined angle may be 30 degrees, 60 degrees, 90 degrees, etc., for example. Those of ordinary skill in the art can select a suitable predetermined angle according to the structure of the first electrical connector 100. Arrangement of the protrusion 620 allows the pull tab 600 to stop when it has rotated through a predetermined angle, ensuring that pulling the pull tab 600 at this time is labor-saving and comfortable.

Preferably, as shown in FIG. 3, the first electrical connector 100 may further comprise a second locking arm 300X2. The first locking arm 300X1 and the second locking arm 300X2 may have the same structure or similar structures. The second locking arm 300X2 may comprise a first end 310X2, a second end 320X2, and an intermediate portion located between the first end 310X2 and the second end 320X2. The intermediate portion may be pivotably mounted to the first housing 200 about a pivot. In the illustrated embodiment, the pivot is determined by the pin roll 343. The first end 310X2 may comprise a locking portion, and the second end 320X2 may comprise a cam surface 321X2. Further, as shown in FIG. 3, the second locking arm 300X2 and the first locking arm 300X1 may be arranged in a mirror image. Thus, the first electrical connector 100 and the second electrical connector 700 may be more closely mated, and may bear a force in a more balanced manner after being mated, thereby achieving higher operating stability.

Figure 4:
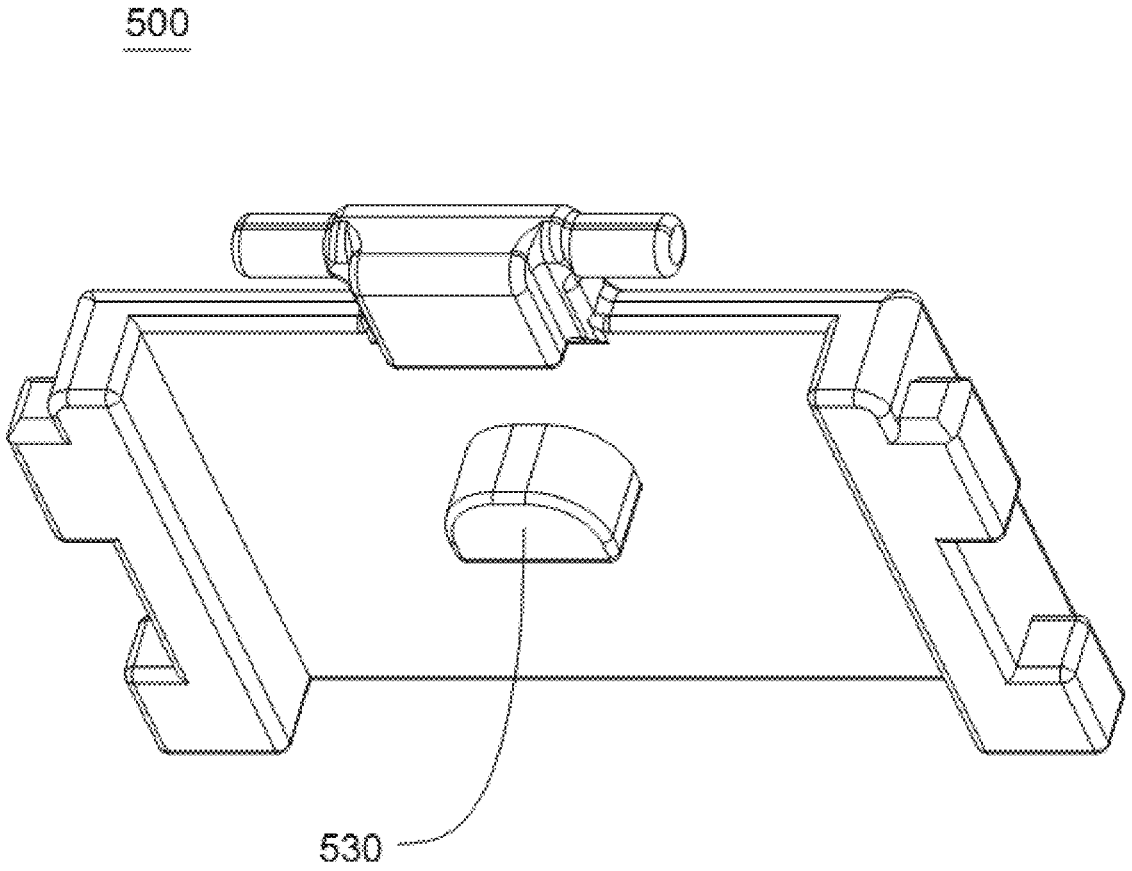
FIG. 4 is a perspective view of the sliding member shown in FIG. 3 from another angle.

Still further, as shown in FIG. 4, the sliding member 500 may comprise a contact protrusion 530 between the first locking arm 300X1 and the second locking arm 300X2. The contact protrusion 530 may contact the cam surface 321X1 of the first locking arm 300X1 and the cam surface 321X2 of the second locking arm 300X2. The cam surface 321X1 of the first locking arm 300X1 and the cam surface 321X2 of the second locking arm 300X2 abut against each other under the action of the biasing member 400. When the sliding member 500 slides in the second direction Y1, the contact protrusion 530 contacts and pushes the cam surface 321X1 of the first locking arm 300X1 and the cam surface 321X2 of the second locking arm 300X2, and the cam surface 321X1 and the cam surface 321X2 are separated from each other, so that the first end 310X1 of the first locking arm 300X1 moves in the direction X2, and the first end 310X2 of the second locking arm 300X2 moves in the direction X1. Thus, the locking portion of the first locking arm 300X1 and that of the second locking arm 300X2 may be disengaged from the components of the second electrical connector 700. Because of the arrangement of the contact protrusion 530, the sliding member 500 has a relatively simple structure and a low manufacturing cost. Preferably, the contact protrusion 530 may have a curved surface, so that the contact protrusion 530 meets with low resistance when contacting the cam surface 321X1 of the first locking arm and the cam surface 321X2 of the second locking arm, and the resistance encountered by the sliding member 500 when sliding in the second direction Y2 is reduced.

When only one locking arm is provided, the position and operating principle of the contact protrusion 530 are the same as when two locking arms are provided; therefore, for the sake of brevity, no further details will be given herein.

As shown in FIGS. 1 to 3, the first housing 200 may be provided with a first chute 221 and a second chute 222. The first chute 221 and the second chute 222 may extend and be spaced apart in the second direction Y1. The sliding member 500 may be provided with a first sliding block 521 matching the first chute 221 and a second sliding block 522 matching the second chute 222. The first sliding block 521 can slide into the first chute 221 from the interval 223 between the first chute 221 and the second chute 222. The first sliding block 521 can slide in the first chute 221, and the second sliding block 522 can slide in the second chute 222. The first chute 221 and the second chute 222 may be the same or different, and the first chute 521 and the second chute 222 may also be the same or different. Thus, during assembly, the contact protrusion 530 of the sliding member 500 may be aligned with the space 540 between the biasing member 400 and the second end 320X1 of the first locking arm 300X1 as well as the second end 320X2 of the second locking arm 300X2, and at the same time the first sliding block 521 may be aligned with the interval 223 between the first chute 221 and the second chute 222. After the first sliding block 521 is aligned with the first chute 221 in the second direction Y1, the sliding member 500 is pulled in the second direction Y1 to complete the assembly of the sliding member 500 and the first housing 200. Thus, the assembly of the first electrical connector 100 may be made simple, take a short time, and carry a low cost. Based on this, the top of the chute 220 (namely, the upper part of the chute shown in the figure) may further be provided with a stopper 230 to prevent the sliding member 500 from separating from the first housing 200 when sliding in the second direction Y1.

Figure 5A:
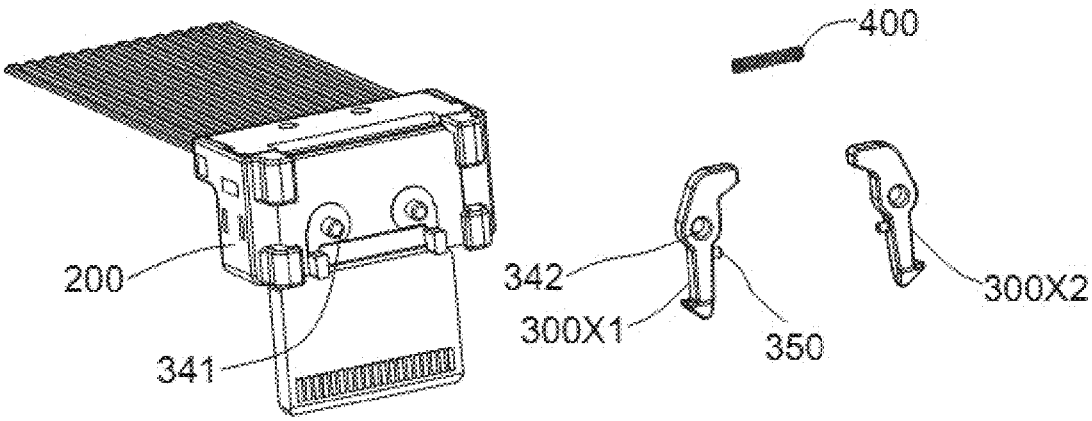
FIGS. 5A to 5H show multiple schematic diagrams for the first electrical connector in the assembly process according to an exemplary embodiment of the present disclosure.
Figure 5B:
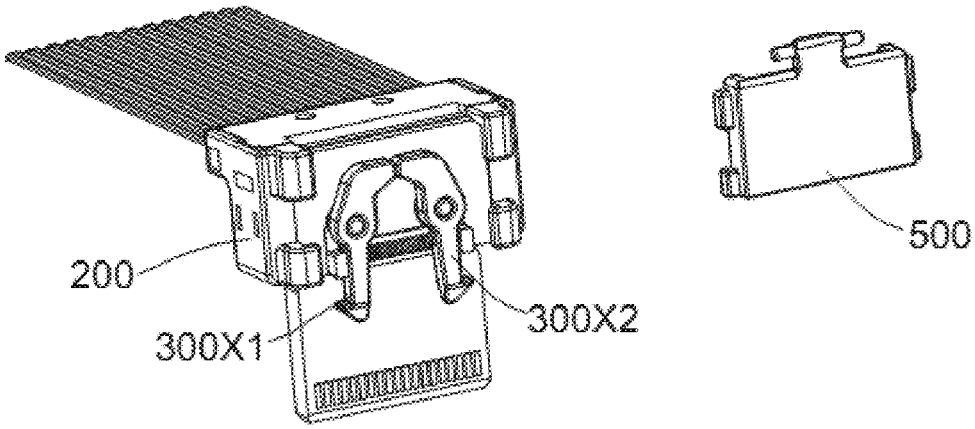

FIGS. 5A to 5E show the assembly process of the first electrical connector 100. As shown in FIG. 5A, the locking arm and the biasing member 400 are first engaged with the first housing 200. When there are two locking arms, they are respectively engaged with the first housing 200. When there is only one locking arm, the locking arm may be engaged with the first housing 200. The principle of the present disclosure will be explained below taking the illustrated embodiment as an example, in which the first locking arm 300X1 and the second locking arm 300X2 are respectively engaged with the first housing 200, for example, by sleeving the pivot hole 342 on the pin roll 341 on the first housing 200. Then, the biasing member 400 may be sleeved on the positioning column 350 on the first locking arm 300X1 and that on the second locking arm 300X2, as shown in FIG. 5B.

Figure 5C:
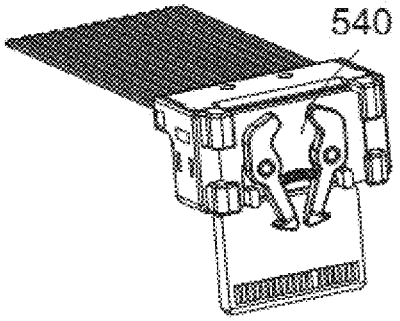
Figures 1, 5D:
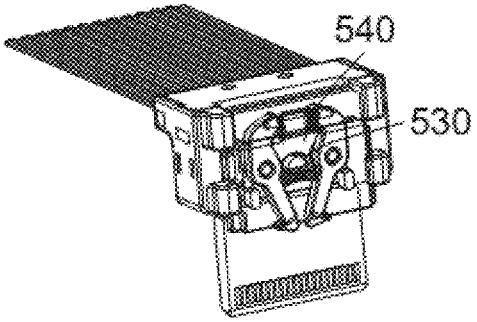
Figures 2, 5D:
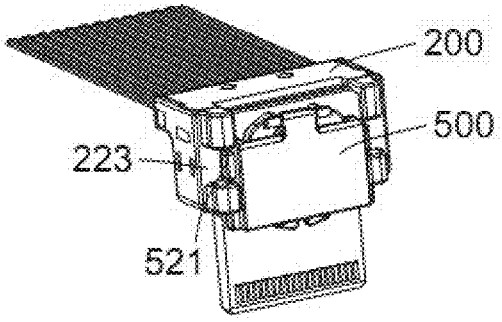
Figures 1, 5E:
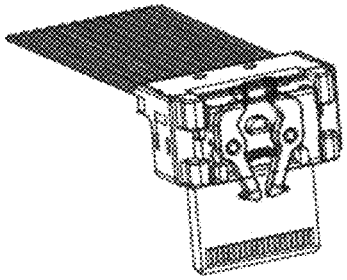
Figures 2, 5E:
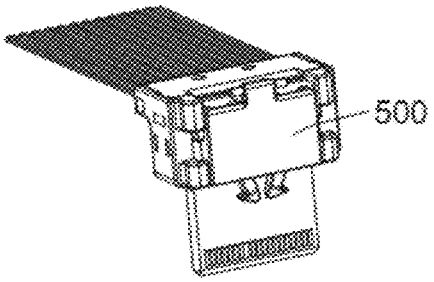
Figures 1, 5F:
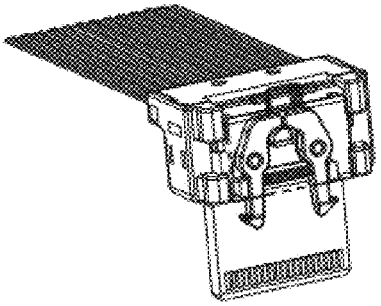
Figures 2, 5F:
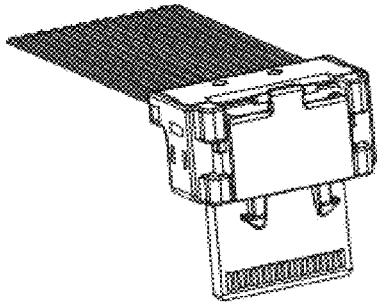

The sliding member 500 is then connected to the first housing 200, referring to FIGS. 5C, 5D-1 and 5D-2, FIGS. 5E-1 and 5E-2, and FIGS. 5F-1 and 5F-2. Before the sliding member 500 is connected to the first housing 200, a force may be exerted on the first ends of the two locking arms to make them abut against each other, as shown in FIG. 5C, thereby enlarging the space 540 surrounded by the second ends of the two locking arms and the biasing member; this enables fitting the contact protrusion of the sliding member 500 into the space 540. As shown in FIGS. 5D-1 and 5D-2, while fitting the contact protrusion 530 of the sliding member 500 into the space 540, attach the first sliding block 521 from the interval 223 between the first chute and the second chute to the first housing 200; then, slide the first sliding block 521 into the upper first chute from the interval 223, and remove the external force exerted on the first ends of the two locking arms. Thus, the assembly of the sliding member 500 is completed.

Figure 5G:
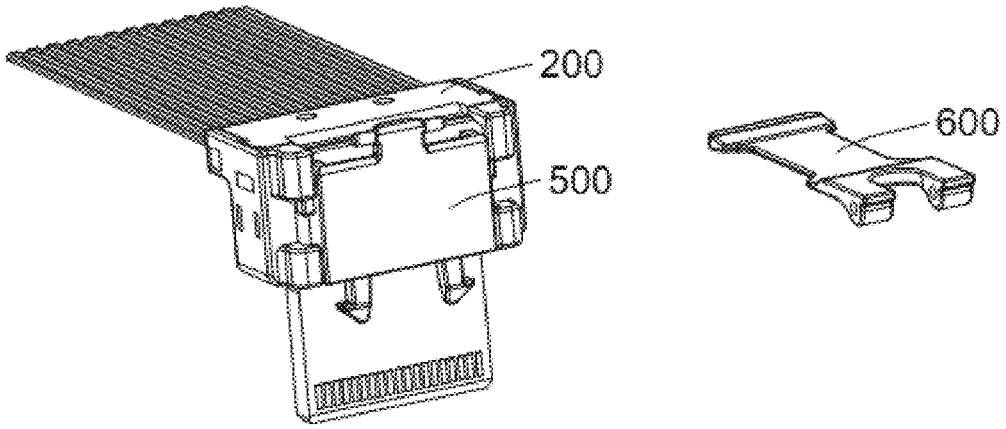
Figure 5H:
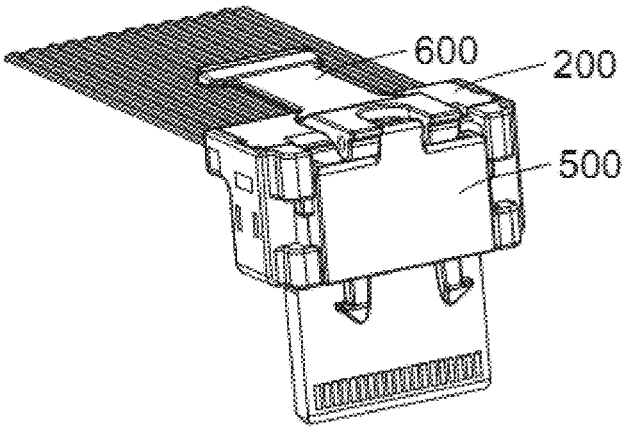

If a pull tab 600 is provided, then the pull tab 600 may be mounted on the sliding member 500, as shown in FIGS. 5G and 5H. Certainly, the pull tab 600 may also be mounted on the sliding member 500 before the sliding member 500 is mounted on the first housing 200.

Referring back to FIGS. 1 and 2, the second electrical connector 700 may comprise a mounting surface 760 arranged in a plane. The mounting surface 760 may be configured as a surface for being mounted to a printed circuit board (not shown). In the illustrated embodiment, the mounting surface 760 may, through conductive terminals thereon, be soldered to the surface of the printed circuit board, so that the mounting surface 760 is mounted on the surface of the printed circuit board. The mounting surface 760 may also be mounted on the surface of a printed circuit board in various manners that are known in the art or may emerge in the future. The elongated opening 720 and the at least one groove 740 may be formed on the surface of the second housing 710 opposite to the mounting surface 760. The elongated opening 720 is configured to accommodate a mating portion of the first electrical connector 100, for example, the circuit board 110. Through the elongated opening 720, the circuit board 110 may be electrically connected to a printed circuit board.

According to another aspect of the present disclosure, a method for mating and unmating a first electrical connector and a second electrical connector is further provided.

A method for mating the first electrical connector 100 and the second electrical connector 700 comprises the following steps: first, insert the first electrical connector 100 into the second electrical connector 700 so that the first end of the locking arm contacts members 751 of the second electrical connector 700; then, further insert the first electrical connector 100 into the second electrical connector 700; taking the first locking arm 300X1 as an example, the first end 310X1 of the first locking arm 300X1 pivots in the direction X2 away from the member 751 of the second electrical connector 700, as shown in FIGS. 6A and 6B; and then further insert the first electrical connector 100 into the second electrical connector 700, the locking portion 311 at the first end 310X1 of the first locking arm 300X1 clear the members 751 of the second electrical connector 700. The first end 310X1 of the first locking arm 300X1 is bounced back in the direction X1 toward the components of the second electrical connector 700 to lock the first electrical connector 100 to the second electrical connector 700, as shown in FIGS. 7A and 7B; in this case, the locking portion 311 is locked to the members 751 of the second electrical connector 700. The components of the second electrical connector 700 may include the undercut portion 750 configured to hold the locking portions 311.

Figure 8A:
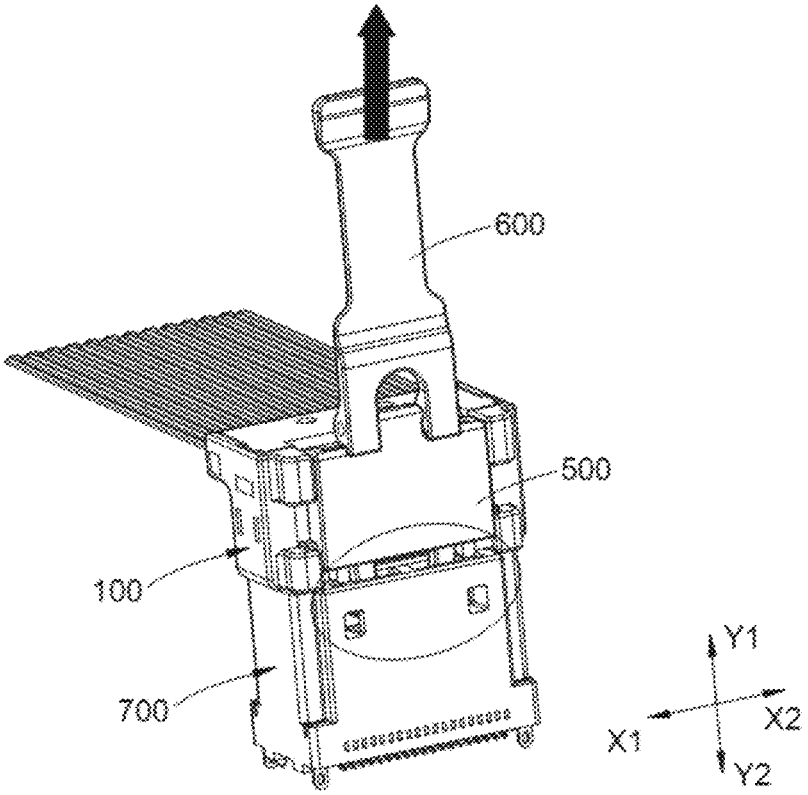
FIGS. 8A to 8D show schematic diagrams for the first electrical connector and the second electrical connector in the process of unmating according to an exemplary embodiment of the present disclosure, FIGS. 8A and 8B showing states in which the sliding member is just beginning to slide, the difference between the two states being that the sliding member is shown non-perspectively and perspectively in FIGS. 8A and 8B, respectively.
Figure 8B:
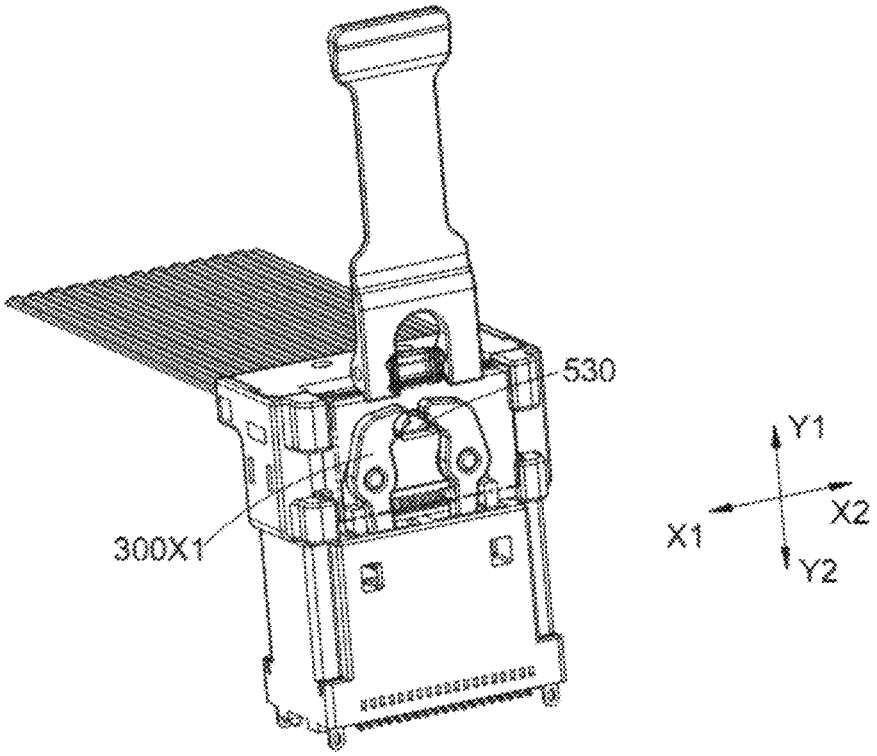
Figure 8C:
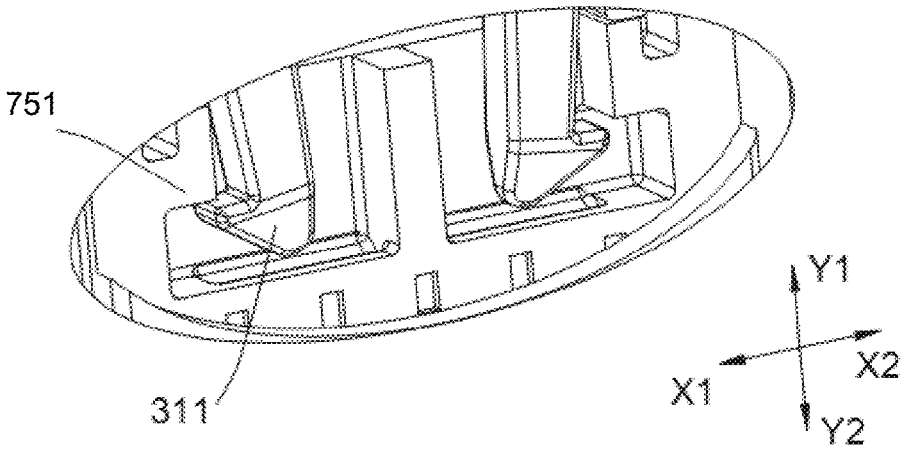
Figure 8D:
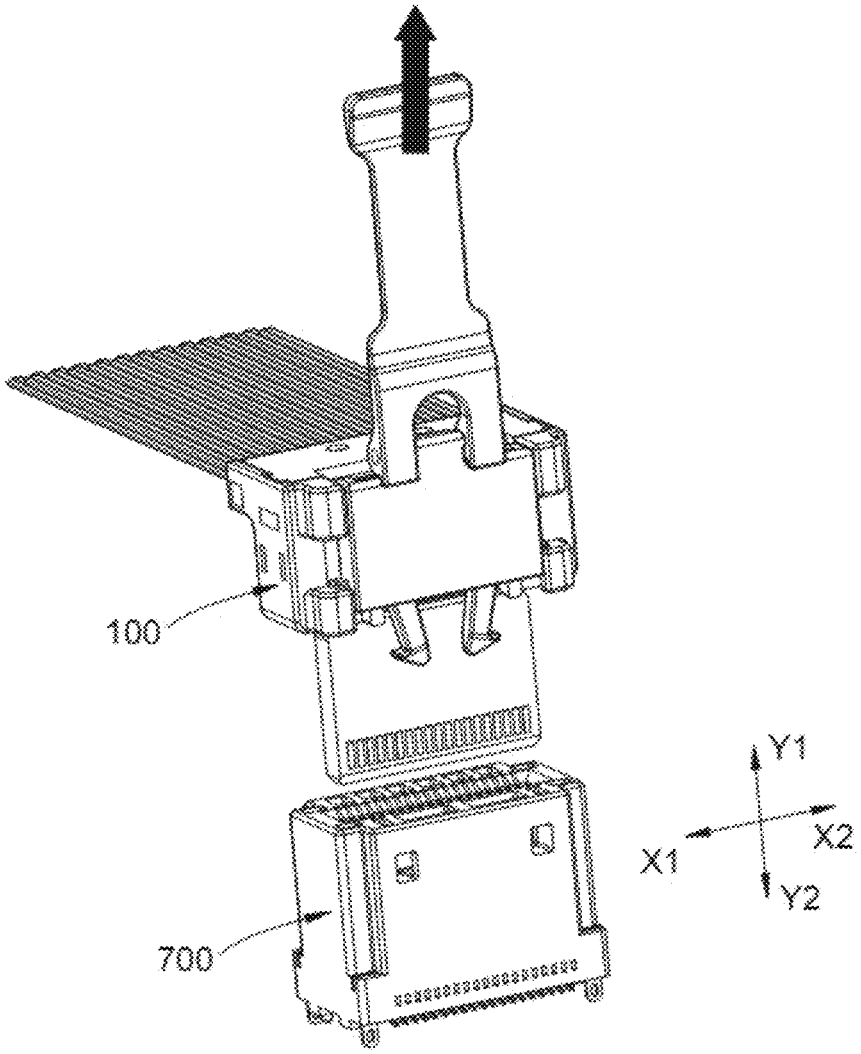

A method for unmating the first electrical connector 100 and the second electrical connector 700 comprises the following steps: first, slide the sliding member 500 of the first electrical connector 100 relative to the first housing 200 (as shown in FIG. 8A), so that the sliding member 500 of the first electrical connector 100 contacts the second end of the locking arm; taking the first locking arm 300X1 as an example, the contact protrusion 530 may be caused to contact the second end of the first locking arm 300X1, as shown in FIG. 8B; then, further slide the sliding member 500 of the first electrical connector 100 relative to the first housing 200, so that the sliding member 500 of the first electrical connector 100 pushes the second end 320X1 of the first locking arm 300X1 in the direction X1, and the locking portion 311 at the first end of a locking arm 300X1 moves in the direction X2 away from the members 751 of the second electrical connector 700; in other words, the locking portion 311 is away from the undercut portion 750, as shown in FIG. 8C, to unlock the first electrical connector 100 from the second electrical connector 700; and then remove the first electrical connector 100 from the second electrical connector 700, as shown in FIG. 8D.

As shown in FIG. 8A, sliding the sliding member 500 of the first electrical connector 100 comprises pulling the pull tab 600 connected to the sliding member 500 of the first electrical connector 100. The pull tab 600 may be rotatably connected to the sliding member 500. In this case, a method for unmating the first electrical connector 100 and the second electrical connector 700 further comprises rotating the pull tab 600 relative to the sliding member 500 and pulling the pull tab 600 in a direction in which the sliding member 500 slides.

As mentioned above, the first electrical connector 100 may further comprise a second locking arm 300X2, and the second locking arm 300X2 and the first locking arm 300X1 are arranged in a mirror image. In this case, actions of the second locking arm 300X2 and of the first locking arm 300X1 during the process of mating and unmating the first electrical connector 100 and the second electrical connector 700 are also mirrored.

Therefore, while the present disclosure has been explained with reference to the above-described embodiments, it should be understood that those of ordinary skill in the art can make more variations, modifications and improvements to the embodiments based on the teachings of the present disclosure, and that such variations, modifications, and improvements all fall within the spirit and the scope of protection of the present disclosure. The scope of protection of the present disclosure is defined by the appended claims and equivalent scopes thereof. The above-described embodiments only serve purposes of illustration and description, instead of being intended to limit the present disclosure to the scope of the described embodiments.

According to some embodiments, an electrical connector is provided. The electrical connector comprises a housing, a locking arm, a biasing member, and a sliding member. The locking arm comprises a first end, a second end, and a middle portion, the middle portion being located between the first end and the second end, wherein the first end comprises a locking portion, the middle portion is pivotably mounted to the housing about a pivot, and the second end comprises a cam surface. The biasing member is engaged with the locking arm to drive the first end in a first direction. The sliding member is slidably connected to the housing, the sliding member being configured to slide in a second direction perpendicular to the first direction and contact the cam surface, so that the second end moves in the first direction, the locking arm pivots relative to the housing, and the first end moves in a direction opposite to the first direction.

In some embodiments, the biasing member is engaged with a portion of the locking arm between the pivot and the first end, the biasing member pushing the portion in the first direction.

In some embodiments, the electrical connector further comprises a pull tab, the pull tab being connected to the sliding member.

In some embodiments, the pull tab is rotatably connected to the sliding member.

In some embodiments, the pull tab comprises a protrusion that is configured to engage with the sliding member and prevent the pull tab from further rotating when the pull tab rotates to a predetermined angle relative to the sliding member.

In some embodiments, the biasing member comprises a coil spring.

In some embodiments, the locking portion comprises a hook extending in the first direction.

In some embodiments, the electrical connector comprises a right-angle plug electrical connector.

In some embodiments, the locking arm is a first locking arm, and the electrical connector further comprises a second locking arm.

In some embodiments, the second locking arm and the first locking arm are arranged in a mirror image.

In some embodiments, the sliding member comprises a contact protrusion between the first locking arm and the second locking arm, the contact protrusion contacting the cam surface of the first locking arm and the cam surface of the second locking arm.

In some embodiments, the housing is provided with a first chute and a second chute that are spaced apart in the second direction and extend in the second direction, the sliding member is provided with a first sliding block matching the first chute and a second sliding block matching the second chute, and the first sliding block slides into the first chute from the gap between the first chute and the second chute.

According to some embodiments, an electrical connector is further provided, comprising a housing provided with an elongated opening that is configured to accommodate a fitting portion of the fitting electrical connector, wherein the elongated opening is surrounded by a wall of the housing. The wall comprises a middle portion having at least one groove, and the opposite sides of the at least one groove comprise an undercut portion that is configured to engage with the locking portions of the two locking arms inserted into the at least one groove when the fitting electrical connector is inserted.

In some embodiments, the electrical connector is a vertical electrical connector.

In some embodiments, the electrical connector comprises a mounting surface arranged in a plane, the mounting surface is configured to be mounted to a surface of a printed circuit board, and the elongated opening and the at least one groove are formed on a surface of the housing opposite to the mounting surface.

According to some embodiments, a method for fitting and unfitting a first electrical connector and a second electrical connector is further provided, wherein the first electrical connector comprises at least one locking arm pivotably mounted to a first housing, the method comprising:

causing, by the following steps, the first electrical connector and the second electrical connector to fit together:

inserting the first electrical connector into the second electrical connector so that a first end of the locking arm contacts the components of the second electrical connector;

further inserting the first electrical connector into the second electrical connector, so that the first end of the locking arm pivots in a direction away from the components of the second electrical connector; and further inserting the first electrical connector into the second electrical connector, so that the locking portion at the first end of the locking arm crosses the components of the second electrical connector, the first end of the locking arm springing back in a direction opposite to the direction to lock the first electrical connector to the second electrical connector;

causing, by the following steps, the first electrical connector and the second electrical connector to unfit:

sliding the sliding member of the first electrical connector relative to the first housing so that the sliding member of the first connector contacts a second end of the locking arm;

further sliding the sliding member of the first electrical connector relative to the first housing so that the sliding member of the first connector pushes a second end of the locking arm in the opposite direction and the first end of the locking arm is away from the components of the second electrical connector to unlock the first electrical connector from the second electrical connector; and removing the first electrical connector from the second electrical connector.

In some embodiments, sliding the sliding member of the first electrical connector comprises pulling a pull tab connected to the sliding member of the first electrical connector.

In some embodiments, the pull tab is rotatably connected to the sliding member.

In some embodiments, the method further comprises rotating the pull tab relative to the sliding member and pulling the pull tab in a direction in which the sliding member slides.

In some embodiments, the components of the second electrical connector include an undercut portion on a side surface of at least one groove in a second housing; and the locking arm locks the first electrical connector to the second electrical connector by being locked to the underside of the undercut portion.

In some embodiments, the locking arm is a first locking arm, and the first electrical connector further comprises a second locking arm; and further inserting the first electrical connector into the second electrical connector so that the first end of the locking arm pivots in the first direction comprises pivoting a first end of the first locking arm towards a first end of the second locking arm.

In some embodiments, the locking arm is a first locking arm, and the first electrical connector further comprises a second locking arm; and further sliding the sliding member of the first electrical connector relative to the housing so that the sliding member of the first connector pushes a second end of the locking arm in the opposite direction and the first end of the locking arm is away from the components of the second electrical connector comprises pushing a second end of the first locking arm and a second end of the second locking arm in opposite directions.

With this arrangement, the first electrical connector may be reliably connected to the second electrical connector, and the structure of the first electrical connector is relatively compact, allowing regular and small dimensions. When the fitted first electrical connector and the second electrical connector are mounted on a printed circuit board, the second electrical connector may be arranged closer to surrounding components on the printed circuit board. Therefore, under the condition that the size of the printed circuit board remains unchanged, more components may be arranged on a printed circuit board, so that an electronic product provided with the printed circuit board can achieve the purpose of being miniaturized, integrated, and multi-functional.

Various changes may be made to the structures illustrated and described herein. For example, while the locking mechanism described above is used for a right-angle electrical connector, the locking mechanism is applicable to any suitable electrical connectors, such as vertical electrical connectors and coplanar electrical connectors. For another example, in the description given above, the first electrical connector 100 is connected to a cable, and the second electrical connector 700 is connected to a printed circuit board; however, the second electrical connector 700 may also be connected to cables to establish an electrical connection between the cables.

Moreover, although a number of creative aspects are described above with reference to a cable connector having a right-angle structure, it should be understood that aspects of the present disclosure are not limited thereto. Any one of the creative features, whether alone or in combination with one or more other creative features, may also be used in other types of electrical connectors, such as backplane connectors, daughter card connectors, stacking connectors, mezzanine connectors, I/O connectors, and chip sockets.

It should be understood that in the description of the present disclosure, orientations or positional relationships indicated by orientation words, such as "front", "rear", "upper", "lower", "left", "right", "horizontal", "vertical", "perpendicular", "horizontal", "top", and "bottom", are usually based on the orientations or positional relationships shown in the drawings, and are only intended for convenience of describing the present disclosure and brevity of description; under circumstances where no explanations are given to the contrary, these orientation words do not indicate or imply that the device or element referred to must have a specific orientation or be constructed and operated in a specific orientation, and therefore cannot be understood as a limitation of the protection scope of the present disclosure; orientation words "inside" and "outside" refer to the inside and outside with respect to the contour of each component itself.

For convenience of description, spatial relative terms, such as "on . . . ", "above . . . ", "on the upper surface of . . . ", and "on top of", may be used herein to describe a spatial relationship between one or more components or features and another component or feature shown in a figure. It should be understood that spatial relative terms include not only orientations of a component shown in a figure, but also different orientations in use or operation. For example, if the components in a drawing are inverted as a whole, then a component's being "above another component or feature" or "on another component or feature" will include circumstances in which the component is "below another component or structure" or "under another component or structure". Therefore, the exemplary term "above . . . " can include both orientations "above . . . " and "below . . . " In addition, these components or features may also be positioned at other different angles (for example, by being rotated through 90 degrees or another angle), and it is intended to cover all of these circumstances herein.

It should be noted that the terms used herein are only for describing specific implementations, instead of being intended to limit exemplary implementations according to the present application. As used herein, unless expressly indicated otherwise in the context, a singular form is also intended to include its plural form; in addition, it should also be understood that when the terms "comprising" and/or "including" are used in this description, they indicate the existence of features, steps, operations, parts, components, and/or a combination thereof.

Note that terms such as "first" and "second" used in the specification and claims of the present application and the above-mentioned drawings are intended to differentiate between similar targets, instead of describing a specific sequence or a precedence relationship. It should be understood that data used in this way are interchangeable where appropriate, so that embodiments of the present application described herein may be implemented in a sequence other than any of those shown or described herein.

What is claimed is:

1. An electrical connector, comprising:

a housing;

a first locking arm and a second locking arm, each of the first locking arm and second locking arm comprising a first end, a second end, and an intermediate portion between the first end and the second end, wherein the first end comprises a locking portion, the intermediate portion is pivotably mounted to the housing, and the second end comprises a cam surface;

a biasing member engaged with the locking arm to drive the first end in a first direction; and a sliding member slidably connected to the housing and comprising a protrusion between the first locking arm and the second locking arm, wherein:

the sliding member is configured to slide in a second direction perpendicular to the first direction and contact the cam surface of the first locking arm and the cam surface of the second locking arm with the protrusion, such that the second end moves in the first direction, the first locking arm pivots with respect to the housing, and the first end moves in a direction opposite to the first direction.

2. The electrical connector as claimed in claim 1, wherein the biasing member is engaged with a portion of the first locking arm between the pivot and the first end and configured to push the portion in the first direction.

3. The electrical connector as claimed in claim 1, further comprising a pull tab coupled to the sliding member.

4. The electrical connector as claimed in claim 3, wherein the pull tab is rotatably coupled to the sliding member.

5. The electrical connector as claimed in claim 4, wherein the pull tab comprises a protrusion configured to engage with the sliding member and block further rotation of the pull tab when the pull tab is rotated into a predetermined angle with respect to the sliding member.

6. The electrical connector as claimed in claim 1, wherein the biasing member comprises a coil spring.

7. The electrical connector as claimed in claim 1, wherein the locking portion comprises a hook extending in the first direction.

8. The electrical connector as claimed in claim 1, wherein the electrical connector comprises a right-angle plug electrical connector.

9. An electrical connector, comprising:

a housing;

a locking arm comprising a first end, a second end, and an intermediate portion between the first end and the second end, wherein the first end comprises a locking portion, the intermediate portion is pivotably mounted to the housing, and the second end comprises a cam surface;

a biasing member engaged with the locking arm to drive the first end in a first direction; and a sliding member slidably connected to the housing, wherein:

the sliding member is configured to slide in a second direction perpendicular to the first direction and contact the cam surface, such that the second end moves in the first direction, the locking arm pivots with respect to the housing, and the first end moves in a direction opposite to the first direction, the housing comprises a first chute and a second chute that are spaced apart in the second direction and extend in the second direction, and the sliding member comprises a first sliding block matching the first chute and a second sliding block matching the second chute.

10. The electrical connector as claimed in claim 9, wherein the locking arm is a first locking arm, and the electrical connector further comprises a second locking arm.

11. The electrical connector as claimed in claim 10, wherein the second locking arm is the mirror image of the first locking arm.

12. The electrical connector as claimed in claim 11, wherein the sliding member comprises a protrusion between the first locking arm and the second locking arm and configured to contact the cam surface of the first locking arm and the cam surface of the second locking arm.

13. The electrical connector as claimed in claim 9, wherein the electrical connector is configured to mate with another electrical connector comprising a housing having an undercut portion on a side surface of at least one groove; and the locking arm of the electrical connector is configured to latch to an underside of the undercut portion.

14. An electrical connector, comprising:

a housing comprising an elongated opening, the elongated opening configured to accommodate a mating portion of a mating electrical connector, wherein:

the elongated opening is surrounded by a wall of the housing, the wall comprises a middle portion having at least one groove, the at least one groove comprises undercut portions on opposite sides, and the undercut portions are configured to engage with locking portions of two locking arms inserted into the at least one groove when the mating electrical connector is inserted.

15. The electrical connector as claimed in claim 14, comprising:

a mounting surface arranged in a plane and configured to be mounted to a surface of a printed circuit board, wherein the elongated opening and the at least one groove are formed on a surface of the housing opposite to the mounting surface.

16. A method for operating a first electrical connector and a second electrical connector to mate and unmate, wherein the first electrical connector comprises at least one locking arm pivotably mounted to a first housing, the method comprising:

mating the first electrical connector and the second electrical connector by:

inserting the first electrical connector into the second electrical connector such that a first end of the locking arm contacts a member of the second electrical connector;

further inserting the first electrical connector into the second electrical connector such that the first end of the locking arm pivots away from the components of the second electrical connector; and further inserting the first electrical connector into the second electrical connector such that the locking portion at the first end of the locking arm clears the member of the second electrical connector and the first end of the locking arm springs back towards the member of the second electrical connector to lock the first electrical connector to the second electrical connector; and unmating the first electrical connector and the second electrical connector by:

sliding the sliding member of the first electrical connector relative to the first housing such that the sliding member of the first connector contacts a second end of the locking arm;

further sliding the sliding member of the first electrical connector relative to the first housing such that the sliding member of the first connector pushes the second end of the locking arm toward the member of the second electrical connector and the first end of the locking arm pivots away from the member of the second electrical connector to unlock the first electrical connector from the second electrical connector; and withdrawing the first electrical connector from the second electrical connector wherein:

the member of the second electrical connector comprises an undercut portion on a side surface of at least one groove in a second housing; and the locking arm locks the first electrical connector to the second electrical connector by latching to an underside of the undercut portion.

17. The method as claimed in claim 16, wherein sliding the sliding member of the first electrical connector comprises pulling a pull tab connected to the sliding member of the first electrical connector.

18. The method as claimed in claim 17, wherein the method further comprises rotating the pull tab relative to the sliding member and pulling the pull tab in a direction in which the sliding member slides.

19. The method as claimed in claim 16, wherein:

the locking arm is a first locking arm and the first electrical connector further comprises a second locking arm; and further inserting the first electrical connector into the second electrical connector such that the first end of the locking arm pivots away from the member of the second electrical connector comprises pivoting a first end of the first locking arm towards a first end of the second locking arm.

20. The method as claimed in claim 16, wherein:

the locking arm is a first locking arm and the first electrical connector further comprises a second locking arm; and further sliding the sliding member of the first electrical connector relative to the housing such that the sliding member of the first connector pushes the second end of the locking arm toward the member of the second electrical connector and the first end of the locking arm pivots away from the member of the second electrical connector comprises pushing the second end of the first locking arm and the second end of the second locking arm in opposite directions.

* * * * *